US006279314B1

(12) United States Patent
Valentian et al.

(10) Patent No.: US 6,279,314 B1
(45) Date of Patent: Aug. 28, 2001

(54) CLOSED ELECTRON DRIFT PLASMA THRUSTER WITH A STEERABLE THRUST VECTOR

(75) Inventors: Dominique Valentian, Rosny-sur-Seine; Eric Klinger, Fontainebleau; Michel Lyszyk, Moissy-Cramayel, all of (FR)

(73) Assignee: Societe Nationale d'Etude et de Construction de Moteurs d'Aviation-S.N.E.C.M.A., Paris (FR)

( * ) Notice: Subject to any disclaimer, the term of this patent is extended or adjusted under 35 U.S.C. 154(b) by 0 days.

(21) Appl. No.: 09/474,546

(22) Filed: Dec. 29, 1999

(30) Foreign Application Priority Data

Dec. 30, 1998 (FR) ..... 98 16631

(51) Int. Cl.[7] ..... F03H 1/00
(52) U.S. Cl. ..... 60/202
(58) Field of Search ..... 60/202; 313/359.1, 313/360.1, 361.1, 362.1; 315/110.01, 111.21, 111.41; 244/169

(56) References Cited

U.S. PATENT DOCUMENTS 5,359,258 * 10/1994 Arkipov ..... 313/359.1
5,489,820 * 2/1996 Ivanov ..... 315/111.51
5,751,113 * 5/1998 Yashnov ..... 315/111.21
5,767,627 * 6/1998 Siniaguine ..... 315/111.41
5,845,880 * 12/1998 Petrosov ..... 244/169
5,847,493 * 12/1998 Yashnov ..... 315/231.31

FOREIGN PATENT DOCUMENTS 0 541 309 A1 5/1993 (EP) .
0 800 196 A1 10/1997 (EP) .

* cited by examiner

*Primary Examiner*—Timothy S. Thorpe
*Assistant Examiner*—Ehud Gartenberg
(74) *Attorney, Agent, or Firm*—Weingarten, Schurgin, Gagnebin & Hayes LLP

(57) ABSTRACT

The thruster comprises, on a common plate, a plurality of main annular ionization and acceleration channels having axes that are not parallel and that converge in the outlet direction of the channels. A magnetic circuit sets up a magnetic field in the annular channels. The thruster also has a hollow cathode, a device for regulating the ionizable gas feed rate to each annular channel, and a device for controlling the ion discharge acceleration current in the channels. The direction of the thrust vector of the thruster can be controlled without significantly increasing the mass of the thruster.

24 Claims, 9 Drawing Sheets

CLOSED ELECTRON DRIFT PLASMA THRUSTER WITH A STEERABLE THRUST VECTOR

FIELD OF THE INVENTION

The invention relates to a closed electron drift plasma thruster having a steerable thrust vector, the thruster comprising at least one main annular ionization and acceleration channel fitted with an anode and ionizable gas feed means, a magnetic circuit for creating a magnetic field in said main annular channel, and a hollow cathode associated with the ionizable gas feed means.

PRIOR ART

By steering the thrust vector of ion thrusters or of closed electron drift thrusters, it is possible to perform attitude control operations by offsetting the thrust vector from the center of gravity of the satellite, or on the contrary, it is possible to counteract parasitic torques by aligning the thrust vector in such a manner as to track the displacements of the center of gravity of the satellite as induced by thermal deformation and by consumption of propellant.

This need has been recognized since the 1970s. Since mechanisms for controlling the thrust vector are naturally rather complex, numerous attempts have been made to replace mechanical thrust control by control that is electrostatic or electromagnetic.

With bombardment ion thrusters, electrostatic deflection has appeared to be the most suitable. The technique most commonly used consists in subdividing each hole of the accelerator grid into four sectors of potential that can be controlled independently, making it possible to achieve an angle of deflection of as much as 3°. Nevertheless, no industrial embodiment has yet been implemented using that type of technique.

Thus, bombardment ion thrusters generally use a mechanical thrust steering device.

By way of example, mention can be made of the Hughes XIPS 13 thrusters on the HS 601 HP satellite and the RIT 10 and UK 10 thrusters on the experimental ARTEMIS satellite.

With closed electron drift thrusters, electro-magnetic deflection has appeared to be the most suitable.

The electric field in a plasma thruster is determined by the radial magnetic field in the magnetic gap. If it is desired to vary the azimuth of the radial magnetic field, the electric field is also varied. The deformation of the equipotential surfaces then causes the angle of the thrust vector to be deflected.

That solution is described, for example, in document U.S. Pat. No. 5 359 258.

Under such circumstances, the external polepiece is subdivided into four sectors, each sector being mounted on a magnetic core with a coaxial coil. Differential feed to the coils serves to modify the azimuth distribution of the magnetic field.

Nevertheless, that disposition has never been used on an operational thruster.

Also known, from document EP 0 800 196 A1, is a thrust steering system in which four coils mounted on four magnetic cores in the form of circular arcs serve to vary the radial magnetic field in azimuth.

Although the various techniques for electro-magnetically controlling the thrust vector of a closed electron drift thruster make it possible to obtain deflection angles of up to 30, they present a series of drawbacks due specifically to the physics of such thrusters. In particular, the fact of locally increasing the electric field changes the position of the erosion zone. Instead of being axially symmetrical, the wear profile then becomes more pronounced on one particular side (since the direction in which the center of gravity of a satellite moves is deterministic). Insofar as it is necessary to change the reference direction in which the beam is pointed, the interface between the plasma and the worn channel wall is no longer symmetrical. This gives rise to wear that is more marked on the side that was previously subjected to moderate wear, but in particular it gives rise to the wear threshold being displaced, and that can be highly disturbing to operation.

It should also be observed that a lifetime test is difficult to specify with an electromagnetically controlled device. As soon as lifetime runs the risk of being a function of the way in which the thrust vector is steered, it becomes practically impossible to demonstrate that the way in which the thrust vector is steered during a lifetime test is more severe than some random law that might be encountered in real operation.

Another drawback is associated with the large drop in efficiency when the ion beam (the thrust vector) is deflected.

In an axially symmetrical thruster, there is nothing opposing the drift motion of the electrons in the annular channel under the effect of the crossed electric and magnetic fields (whence the term "closed electron drift" thrusters).

If the walls of the channels are offset relative to the polepieces, then efficiency is observed to decrease because of the increase in collisions between the electrons and the walls.

The same effect occurs if the magnetic field is increased locally. It will be made worse by asymmetrical wear.

A simple means for controlling the thrust vector can consist in using a plurality of thrusters with the thrust from each being under individual control.

It is then very easy to fix the direction and the amplitude of the resultant thrust vector, and lifetime becomes independent of the way in which thrust is steered. Unfortunately, such a method suffers from the drawback of being expensive when at least three thrusters and at least three electricity power supplies are required.

OBJECT AND BRIEF SUMMARY OF THE INVENTION

The invention seeks to remedy the above-specified drawbacks, and in particular to steer the thrust vector by means of a system that does not excessively increase cost or overall on-board mass, and consequently does not comprise a full set of multiple thrusters, while nevertheless making it possible to achieve control over the steering of the thrust vector that is easy and effective, with deflection angles of sufficient magnitude, and without creating uncontrollable asymmetries.

These objects are achieved by a closed electron drift plasma thruster having a steerable thrust vector, the thruster comprising at least one main annular ionization and acceleration channel fitted with an anode and ionizable gas feed means, a magnetic circuit for creating a magnetic field in said main annular channel, and a hollow cathode associated with the ionizable gas feed means, wherein the thruster comprises a plurality of main annular ionization and acceleration channels having axes that are not parallel and that converge downstream from the outlets of said main annular channels, wherein the magnetic circuit for creating a magnetic field comprises a first external polepiece that is downstream and common to all of the annular channels, a second external polepiece common to all of annular channels and that is disposed upstream from the downstream first external polepiece, a plurality of internal polepieces in number equal to the number of main annular channels and mounted on first cores disposed about the axes of the main annular channels, a plurality of first coils disposed respectively around the plurality of first cores, and a plurality of second coils mounted on second cores disposed in empty spaces left between the main annular channels, said second cores of the second coils being interconnected via their upstream portions by ferromagnetic bars and being connected via their downstream portions to said downstream first external polepiece, and wherein the thruster comprises means for regulating the ionizable gas feed flow rate to each of the main annular channels and means for controlling the ion discharge and acceleration current in the main annular channels.

The axes of the main annular ionization and acceleration channels converge on the geometrical axis of the thruster and may form angles lying in the range 5° to 20° relative to the geometrical axis of the thruster.

Each main annular ionization and acceleration channel comprises an anode associated with a manifold fed with ionizable gas by means of a pipe connected via an isolator to a flow rate regulator.

The hollow cathode is fed by a pipe connected via an isolator to a head loss member.

The flow rate regulators and the head loss member are fed from a common pipe controlled by an electrically controlled valve.

The thruster comprises an electrical power supply circuit for setting up discharge between the hollow cathode and the anodes, and the discharge oscillations of the main annular channels are decoupled by filters placed between the cathode and the anodes.

To control the discharge currents of the anodes, the thruster comprises servo-control loops comprising current pickups and a current regulator acting on the flow rate regulators and receiving a total current discharge reference value and at least one thrust vector deflection reference value for steering about at least one axis, the ion discharge and acceleration current being controlled by a magnetic field distribution determined by said magnetic circuit in which the plurality of first coils and the plurality of second coils are connected in series between the cathode and the negative terminal of the electricity power supply circuit.

The flow rate regulators may be constituted by thermocapillary means controlled by discharge current servo-control loops or else by electrically controlled micromeasuring valves that are actuated thermally, piezo-electrically, or magnetostrictively.

The current pickups may be electrically-isolated in order to measure the current in each of the anodes at a potential of several hundred volts.

Advantageously, the range of flow rates in each main annular channel extends from 50% to 120% of the nominal flow rate.

The number of second coils may lie in the range 4 to 10.

In various possible embodiments, the thruster can comprise two main annular channels, or three main annular channels disposed in a triangle about the axis of the thruster, or else four main angular channels disposed in a square about the axis of the thruster.

In a particular embodiment, the number of second coils is a multiple of the number of main annular channels, the coils of each subset of second coils allocated to each channel are connected in series, and the various subsets of second coils are connected in parallel, with the impedances of the coils connected in series being equal.

In another particular embodiment, the number of second coils is a multiple of the number of main annular ionization and acceleration channels, and the coils of each of the subsets of second coils allocated to the various channels are powered via a current vernier.

In a particular embodiment, the thruster comprises a digital servo-control loop for steering the thrust vector, the total thrust reference value and the thrust vector deflection value being given in digital form, and the thrust vector deflection reference value having priority over the total thrust reference value in the event of the two reference values being incompatible.

Advantageously, the thruster comprises a common baseplate acting as a radiator and as a housing for the electrical and fluid connections.

In an embodiment, the means for regulating the ionizable gas feed rate receive two reference values for thrust vector deflection to provide control about two axes.

In a particular embodiment, the thruster comprises two main annular ionization and acceleration channels making it possible to provide control about a first axis using means for adjusting the ionizable gas feed rate, and it further comprises mechanical hinge means to the baseplate of the thruster about a different axis.

In which case, the baseplate of the thruster is hinged about said second axis with a maximum angle of 50°.

In a particular aspect, the baseplate of the thruster is hinged about said second axis on two ball bearings prestressed by at least one flexible membrane mounted on a fixed platform and fixed directly to the baseplate, the center of gravity of the moving assembly being situated close to the vicinity of the axis of rotation and the angle of rotation being controlled by an electronic motor and a stepdown gear that provide angular locking.

BRIEF DESCRIPTION OF THE DRAWINGS

Other characteristics and advantages of the invention will appear on reading the following description of particular embodiments, given as examples and with reference to the accompanying drawings, in which.

DETAILED DESCRIPTION OF PARTICULAR EMBODIMENTS OF THE INVENTION

In the following description of various embodiments of closed electron drift plasma thrusters provided with respective pluralities of main annular ionization and acceleration channels, items that are similar in the various main annular channels or that are associated with the various different channels are given the same references, but followed by a letter A, B, C, or D depending on whether reference is being made to a first, a second, a third, or a fourth annular channel of a single thruster.

Figure 1:
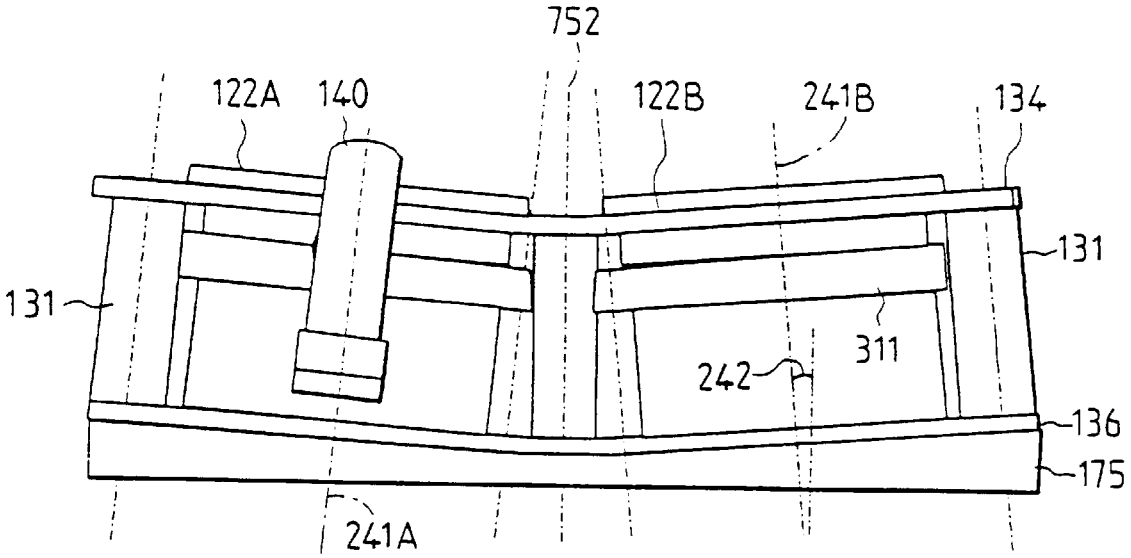
FIG. 1 is a diagrammatic side view showing a first embodiment of a plasma thruster of the invention having two main annular channels.
Figure 2:
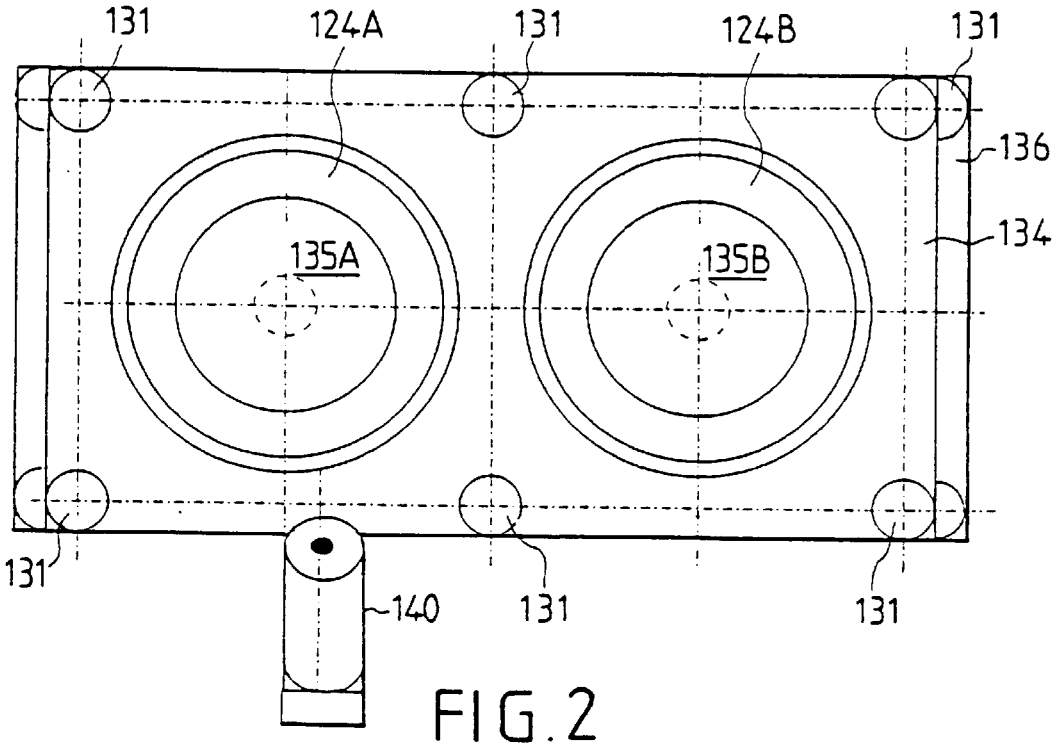
FIG. 2 is an end view seen from downstream and showing the plasma thruster of FIG. 1.
Figure 3:
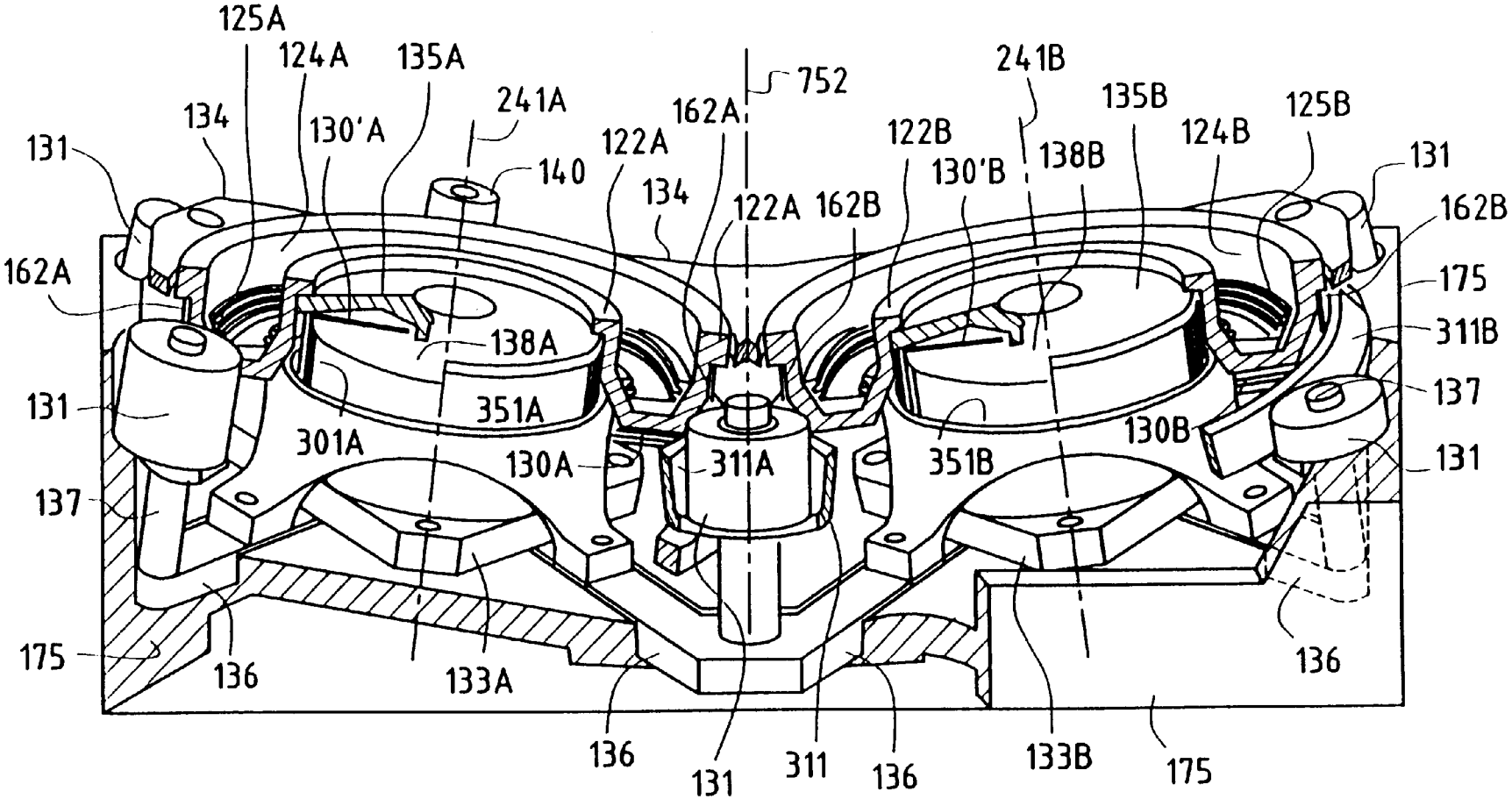
FIG. 3 is a perspective view, particularly in section, of the embodiment of a plasma thruster shown in FIGS. 1 and 2.

FIGS. 1 to 3 show a plasma thruster having two main annular channels 124A and 124B disposed side by side and defining a configuration that is essentially rectangular. The axes 241A and 241B of the two channels 124A and 124B are inclined at an angle 242 relative to the geometrical axis 752 of the thruster. A single hollow cathode 140 is associated with the two main channels 124A and 124B.

Figure 16:
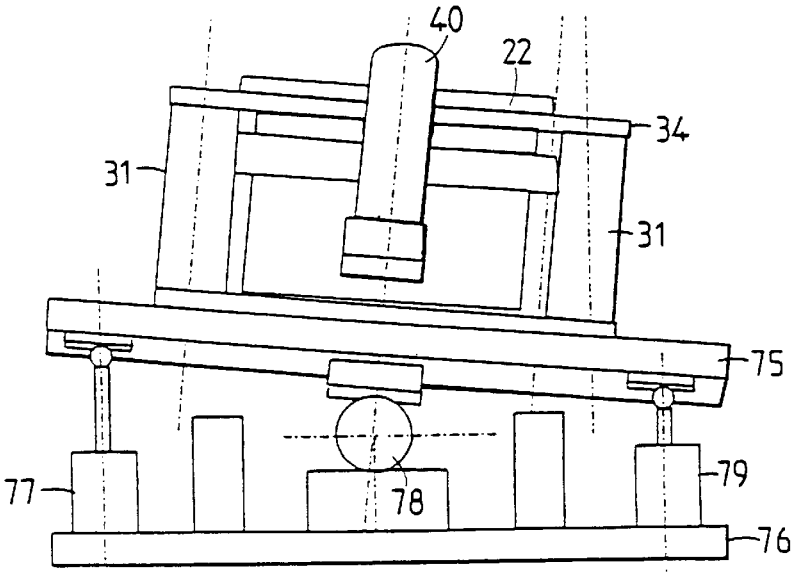
FIG. 16 is a side view showing a prior art plasma thruster comprising a single main annular channel and mechanical pointing means.

A conventional plasma thruster having a single main annular channel, of the kind shown in FIG. 16, includes, in principle, four external coils 31 associated with an external polepiece 34.

With a plasma thruster of the invention, having two main channels 124A and 124B, it is possible to combine pairs of adjacent external coils 131 situated in the vicinity of the midplane between the two channels 124A and 124B. As a result, it is possible to use only six external coils 131 connected to a common external polepiece 134 that is in the form of a very open V-shape (see FIGS. 1 and 2).

Internal polepieces 135A and 135B are mounted on first cores 138A and 138B disposed around the axes 241A and 241B of the main annular channels 124A and 124B, and there are therefore the same number of them as there are annular channels 124A and 124B. Internal or first coils 133A and 133B disposed around the first cores 138A and 138B are also present in a number equal to the number of annular channels 124A and 124B (FIG. 3).

The external coils 131, or "second" coils, are mounted on second cores 137 disposed in empty spaces left between the two main annular channels 124A and 124B. The cores 137 of the coils 131 have their downstream portions connected to the external downstream polepiece 134. Another external polepiece 311 is disposed upstream and has portions 311A and 311B disposed around the annular channels 124A and 124B, and is disposed upstream from the first or downstream external polepiece 134 (FIGS. 3 and 15).

The channels 124A and 124B and the magnetic circuit elements are secured to a baseplate 175 which is preferably made of light alloy and which acts as a radiator. Electricity and fluid connections are housed in cavities provided in the baseplate.

By way of example, the magnetic circuit can be implemented in a manner similar to that described in U.S. Pat. No. 5,359,258, or in a manner similar to that described in French patent application 98/10674 filed on Aug. 25, 1998, and shown in FIGS. 3 and 15.

Figure 14:
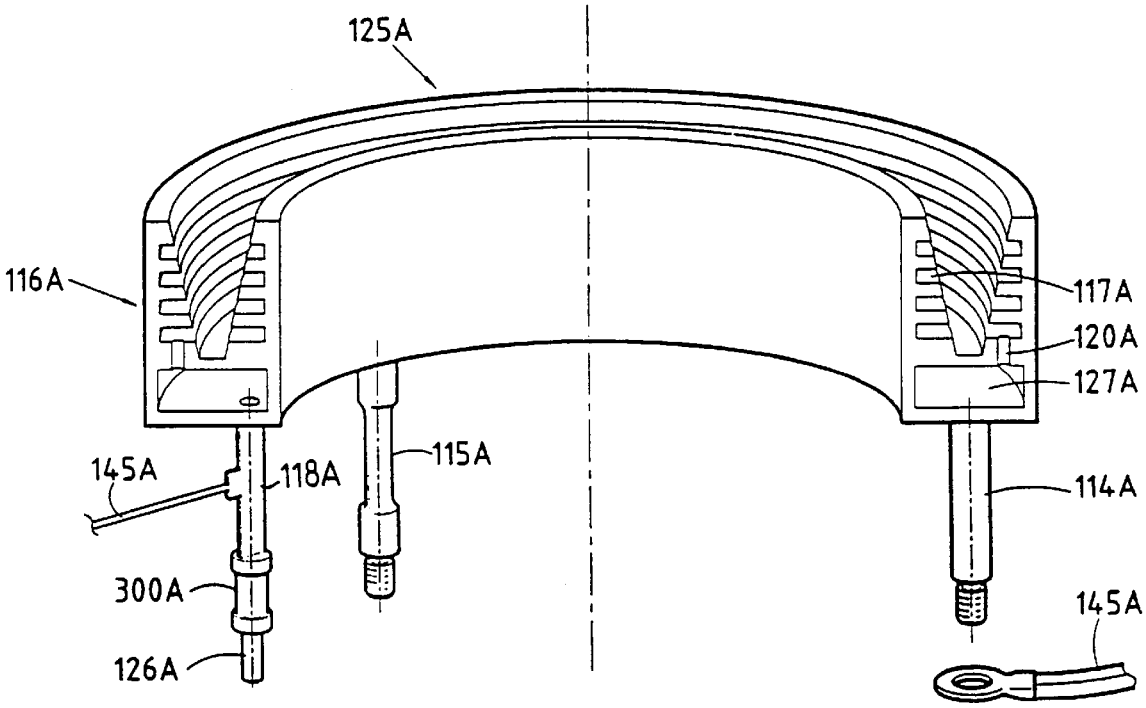
FIG. 14 is a perspective view cutaway in axial section, showing an anode that can be incorporated in each of the main annular channels of a thruster of the invention.
Figure 15:
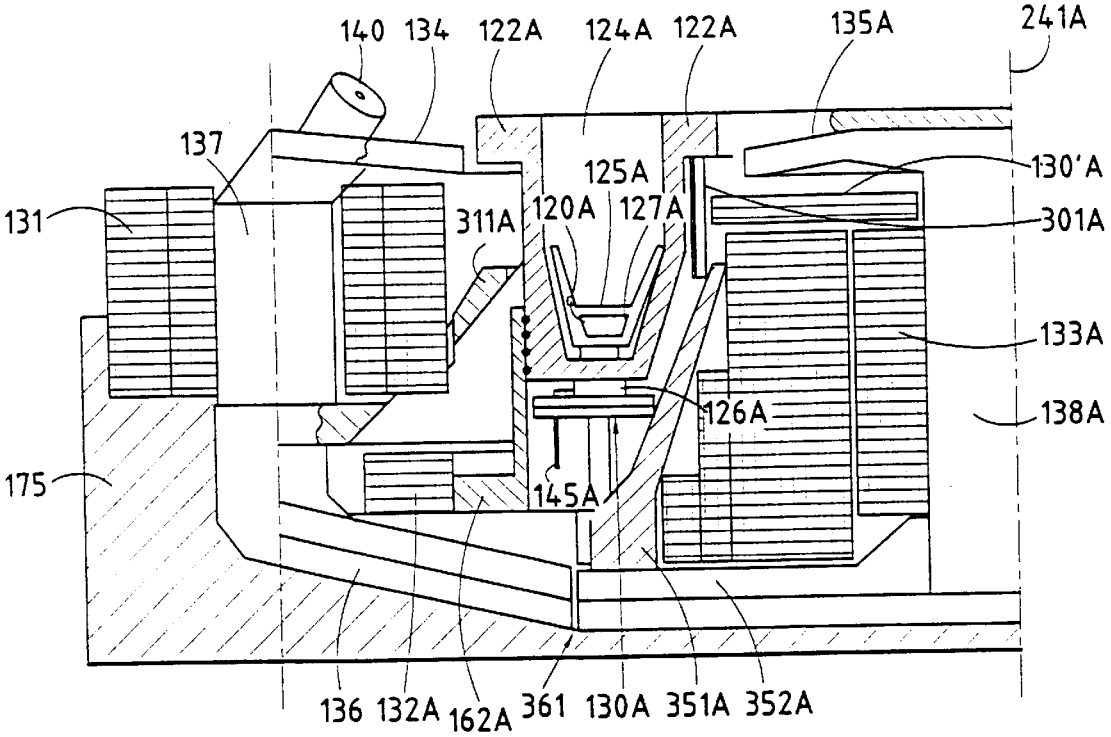
FIG. 15 is an axial half-section view showing one possible embodiment of a main annular channel of a thruster of the invention.

With reference more particularly to FIGS. 3, 14, and 15, it can be seen that each annular channel such as 124A is defined by insulating walls 122A, is open at its downstream end, and has a section that is of frusto-conical shape in its upstream portion and of cylindrical shape in its downstream portion. An annular anode 125A has a tapering section in the form of a portion of a cone that is open in the downstream direction. The anode 125A may have slots 117A formed in the solid portion 116A of the anode 125A to increase its contact area with the plasma. Holes 120A for injecting an ionizable gas coming from an ionizable gas manifold 127A are formed through the wall of the anode 125A. The manifold 127A is fed with an ionizable gas via a pipe 126A. The anode 125A can be supported relative to the parts 122A that are made of ceramic material and that define the channel 124A, e.g. by solid circular-section posts 114A and by at least two posts 115A that are thinner and that constitute flexible blades. An insulator 300A is interposed between the pipe 126A and the anode 125A which is connected by an electrical connection 145A to the positive pole of the electrical power supply for anode-cathode discharge.

The internal polepiece 135A is extended by a central axial magnetic core 138A which is itself extended to the upstream portion of the thruster by a plurality of radial arms 352A connected to a second internal upstream polepiece that is conical in shape 351A. A second internal magnetic coil 132A can be placed in the upstream portion of the second internal polepiece 351A, and outside it. The magnetic field from the internal coil 132A is channeled by radial arms 136 placed in line with the radial arms 352A, and by the external polepiece 311A and by the internal polepiece 351A. A small gap 361 can be left between the radial arms 352A and the radial arms 136.

Screen-forming sheets of superinsulating material 130A are disposed upstream from the annual channel 124A, and sheets of screen-forming superinsulating material 301A are also interposed between the channel 124A and the internal coil 133A. The screens 130A and 301A eliminate the major portion of the flux radiated by the channel 124A towards the coils 133A and 132A, and towards the baseplate 175.

In the context of a plasma thruster of the invention having a plurality of channels 124A, 124B, it is possible to use a single cathode 140 for feeding both channels 124A and 124B. The cathode 140 creates a plasma cloud which makes its positioning fairly insensitive relative to either of the beams, and furthermore since the axes 241A and 241B of the channels 124A and 124B converge, this means that the plasma beams cross, thereby considering reducing impedance between the beams. Nevertheless, it is not impossible to add a redundant cathode, should that be necessary, particularly if the number of channels is greater than or equal to four.

The thruster of FIGS. 1 to 3 having two channels 124A and 124B is capable of steering the thrust vector about one axis.

Thruster configurations having three channels 124A to 124C of the kinds shown in FIGS. 5 to 8 make it possible to steer the thrust vector about two axes.

Figure 5:
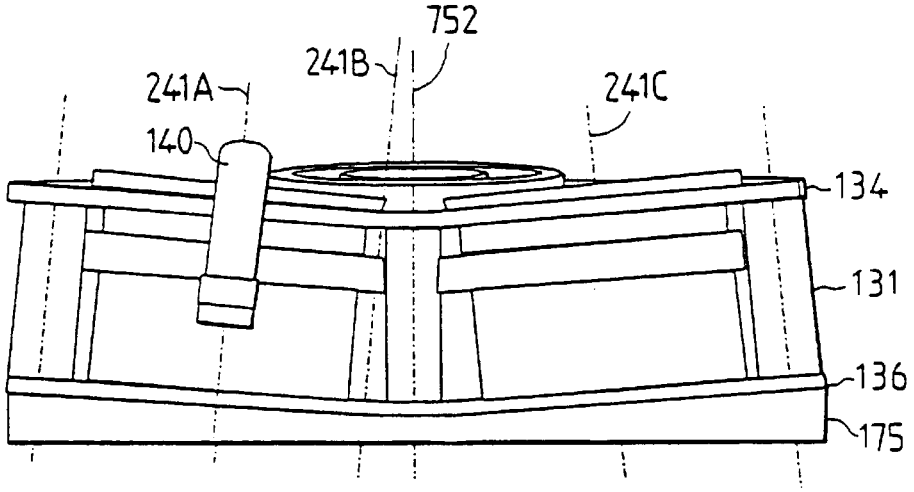
FIG. 5 is a diagrammatic side view showing an embodiment of a plasma thruster of the invention having three main annular channels distributed in a triangle and having seven external coils.
Figure 6A:
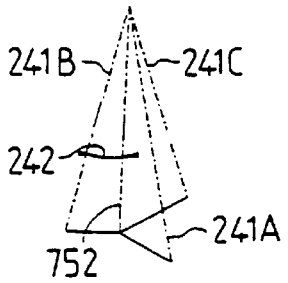
FIG. 6A is a diagram showing how the channels of the thruster of FIGS. 5 and 6 are inclined.
Figure 6:
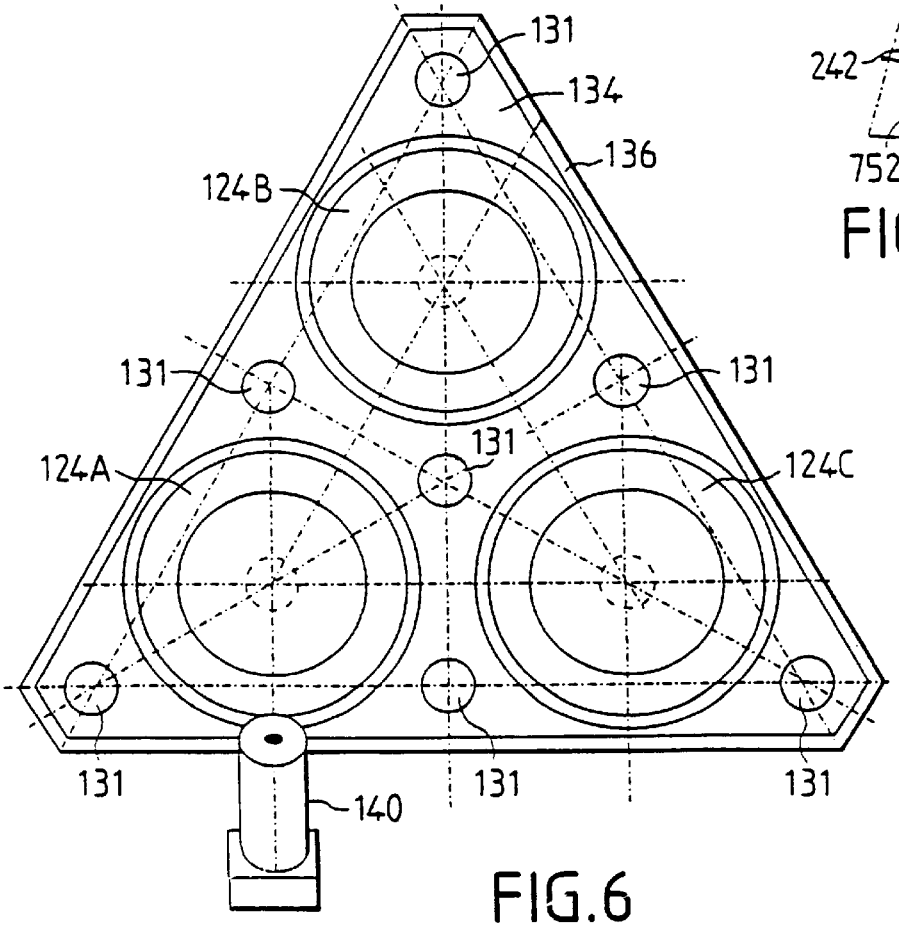
FIG. 6 is an end view seen from downstream and showing the plasma thruster of FIG. 5.

In the embodiment of FIGS. 5 and 6, the axes 241A, 241B, and 241C of the three main annular channels 124A, 124B, and 124C that are disposed in a triangular configuration converge on the axis 752 of the thruster. Each channel 124A to 124C is surrounded by four external coils 131 in a "diamond" configuration. Some of the coils 131 co-operate with two adjacent channels, such that the total number of external coils 131 is reduced to seven instead of being twelve.

The number of ampere-turns of the external coils 131 is adjusted as a function of the perimeter of the polepieces that are to be fed. This number of ampere-turns is identical for the four centermost coils, whereas for the three external coils 131 situated close to the vertices of the triangle defined by the channels 124A to 124C have only two-thirds the number of turns as the central external coils 131.

The other main elements of the thruster having three channels 124A, 124B, and 124C are similar to those of the thruster having two channels 124A and 124B, in particular concerning a common baseplate 175 made of light alloy, the common cathode 140, the magnetic cores 138A to 138C of the internal coils 133A to 133C, and the magnetic cores 137 of the external coils 131 that are interconnected by an array of ferromagnetic bars 136.

Figure 7:
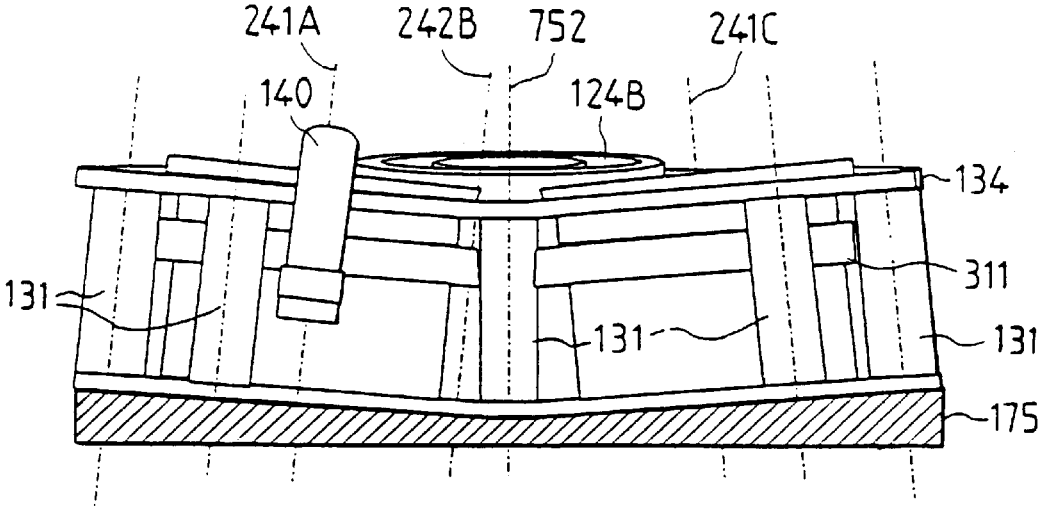
FIG. 7 is a diagrammatic side view showing another embodiment of a plasma thruster of the invention, having three main annular channels distributed as a triangle together with two external coils.
Figure 8:
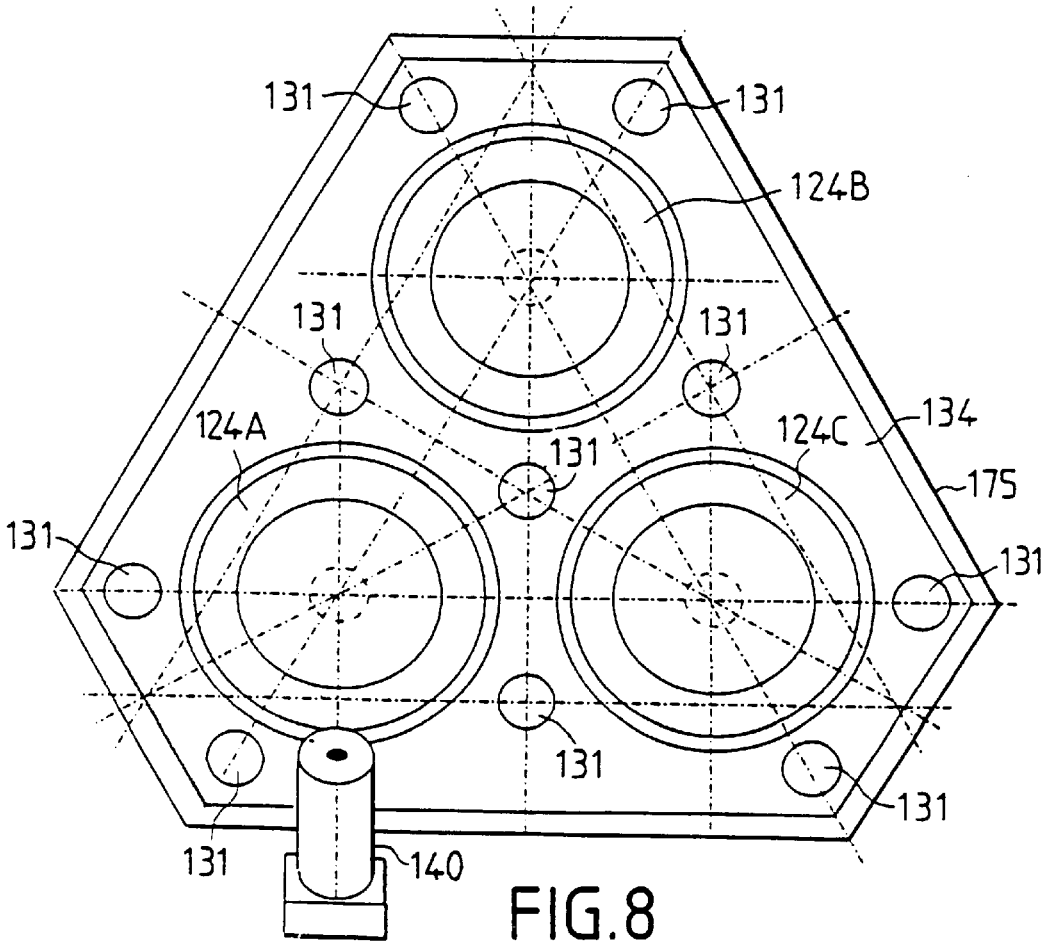
FIG. 8 is an end view seen from downstream and showing the plasma thruster of FIG. 7.

FIGS. 7 and 8 show a thruster having three main annular channels 124A, 124B, and 124C which differs from the embodiment of FIGS. 5 and 6 only in the number and disposition of the external coils 131.

In the embodiment of FIGS. 7 and 8, there are ten external coils 131. These are distributed in such a manner that each main annular channel 124A, 124B, and 124C is surrounded by five coils that form an irregular pentagon. This irregular nature is due to the angle of convergence of the channels which is about 10°. A regular pentagon could be obtained if the angle of convergence of the channels was greater, about 37°. Some of the external coils 131 act simultaneously on two or three of the channels 124A to 124C, such that the total number of external coils 131 is reduced to ten instead of being fifteen. The common polepiece 134 averages the field.

The disposition of FIGS. 7 and 8 is advantageous for large thrusters where it is preferable to subdivide the external coils 131 so as to lighten the external polepiece 134. The external polepiece 134 and the baseplate 175 are in the form of an irregular hexagon having six external coils 131 placed in the vicinity of the vertices of the hexagon, and four external coils 131 distributed in a star configuration between the three channels 124A to 124C.

Figure 9:
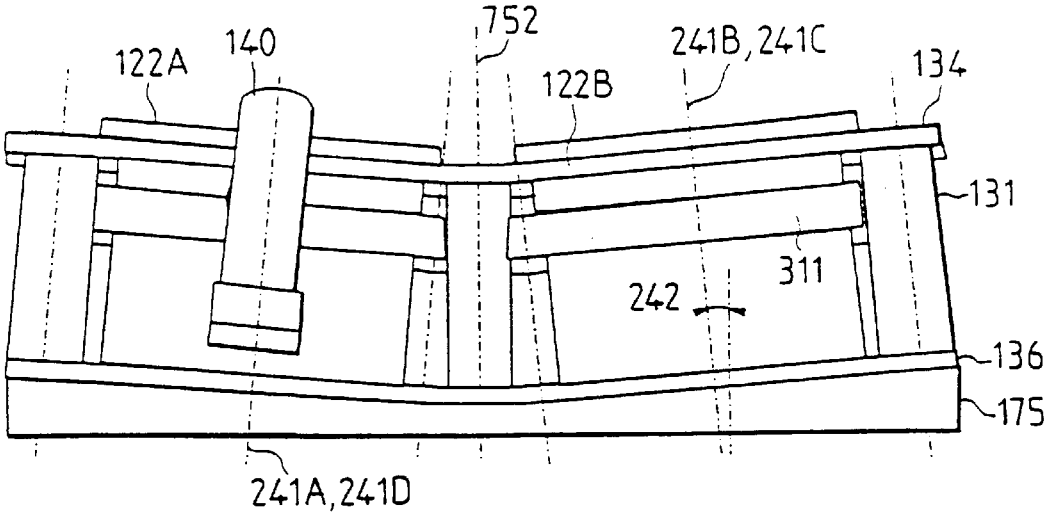
FIG. 9 is a diagrammatic side view showing an embodiment of a plasma thruster of the invention, having four main annular channels distributed in a square and nine external coils.
Figure 10:
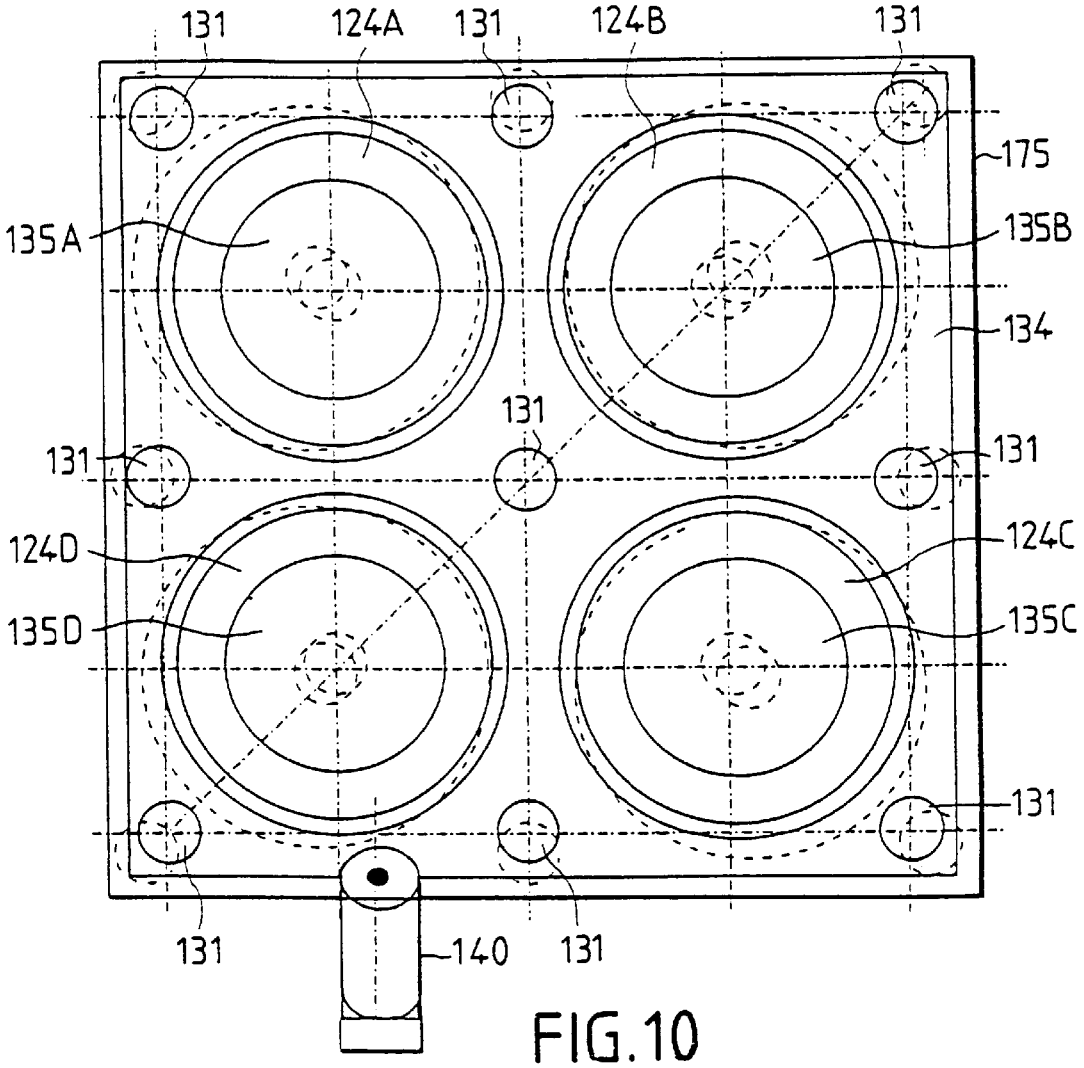
FIG. 10 is an end view seen from downstream and showing the plasma thruster of FIG. 9.
Figure 10A:
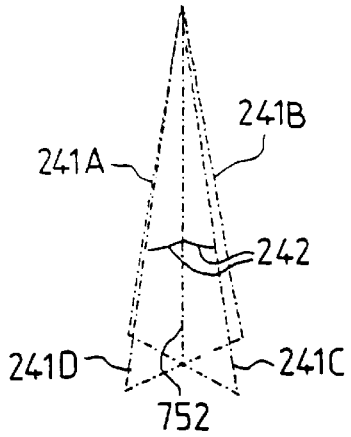
FIG. 10A is a diagram showing the inclinations of the channels in the thruster of FIGS. 9 and 10.

FIGS. 9 and 10 show a thruster having four main annular channels 124A, 124B, 124C, and 124D disposed essentially in a square and associated with nine external coils 131. Each channel 124A to 124D is surrounded by four external coils 131. Some of the external coils 131 act relative to a plurality of channels. Only the coils 131 situated in the vicinity of the corners of the polepiece 134 and of the baseplate 175 which are essentially square in shape act relative to a single channel 124A to 124D only. As a result, the number of external coils 131 can be reduced from sixteen to nine.

To obtain a determined deflection, it is necessary to increase the angle 242 of the axes 241A to 241D relative to the axis 752, said angle 242 becoming twice the angle provided in a thruster that has two channels.

Figure 11:
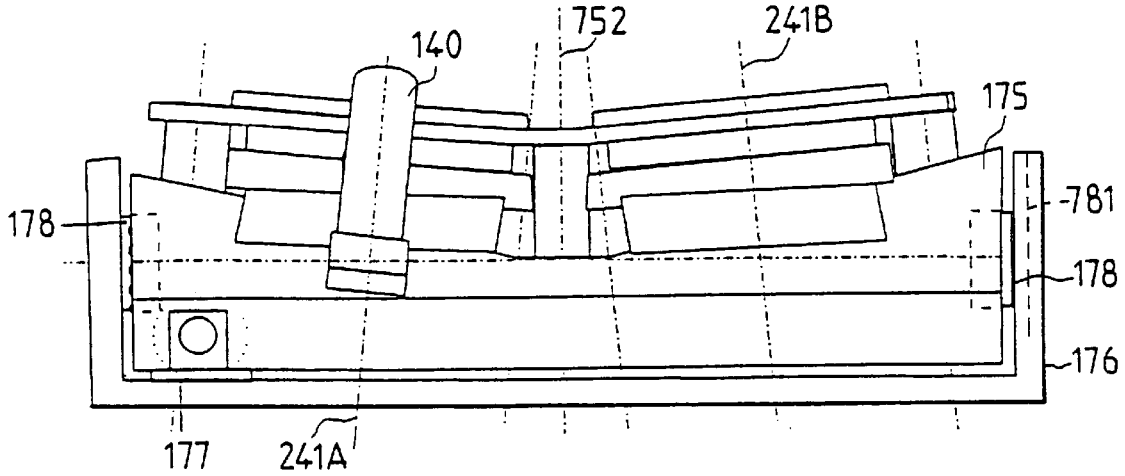
FIG. 11 is a diagrammatic side view showing yet another embodiment of a plasma thruster of the invention, this embodiment having two main annular channels and six external coils, and also being fitted with a mechanical pointing axis.
Figure 12:
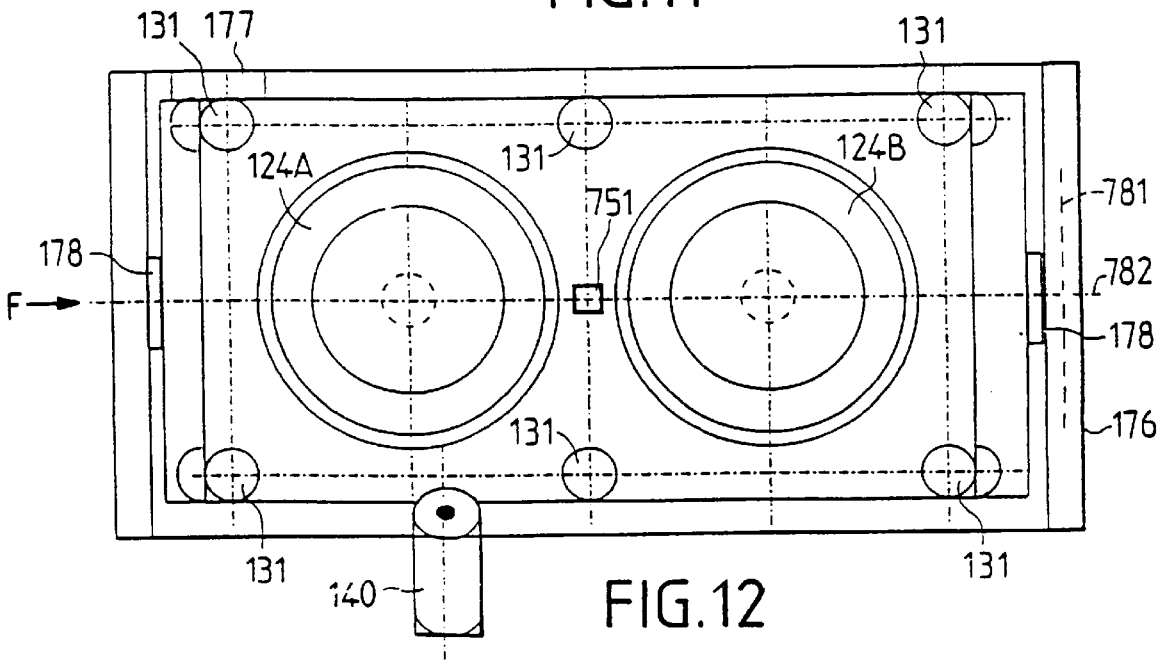
FIG. 12 is an end view seen from downstream and showing the plasma thruster of FIG. 11.
Figure 13:
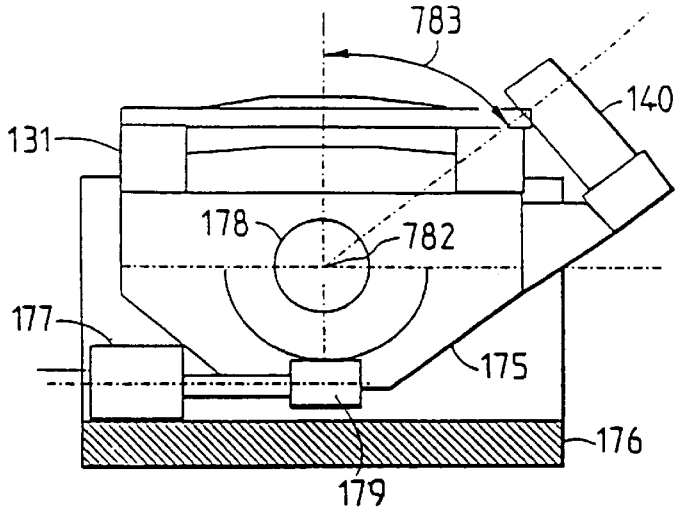
FIG. 13 is a side view seen along arrow F of FIG. 12 and showing implementation details of the mechanical pointing axis.

With reference to FIGS. 11 to 13, there can be seen a thruster of the invention having two channels 124A and 124B essentially similar to the thruster of FIGS. 1 to 3. However, in FIGS. 11 to 13, the thruster is also fitted with single axis mechanical steering means.

The two main annular channels 124A and 124B, and the six external coils 131 associated therewith provide flexible and easy control of the steering of the thrust vector about a first axis through an angle that can lie in the range 5° to 20°. The single axis mechanical steering means make it possible to control the direction of the thrust vector about a second axis, with it being possible to steer said direction through an angle 783 that is large, e.g. about 50°.

It will be observed that a single-axis mechanical steering system is much simpler, much lighter in weight, and much more robust than a two-axis mechanical steering system. In particular, with a single-axis system, the center of gravity 751 of the thruster can be situated on the axis of rotation 782 of the steering device, thereby making it possible to omit any locking device. Angular locking can be obtained directly by means of a non-reversible rotary control mechanism, e.g. comprising an electric motor 177 and a stepdown gear 179. The axis of rotation 782 of the cradle 175 of the mechanically steerable thruster can be implemented by means of two oblique-contact ball bearings 178 capable of withstanding dynamic forces while the thruster is being launched. At least one of the two oblique-contact bearings 178 can be mounted on a resilient membrane 781 making it possible to guarantee constant and independent prestress relative to thermal gradients, thereby avoiding jamming, e.g. as described in European patent 0 325 073. The resilient membrane 781 is itself mounted on a fixed baseplate 176. Electrical connections are provided by flexible cables and ionizable gas feed is provided by hoses.

The thruster having two channels 124A and 124B with single axis mechanical steering is particularly useful when it is required that the thrust vector can be pointed through a large angle of about one axis and through a smaller angle about the other.

This applies in particular for telecommunications satellites that use plasma thrust for the purpose of being transferred between a geostationary transfer orbit (GTO) and a final geostationary orbit (GEO), for the purpose of obtaining North-South control, and also for missions that require a thrust vector to be steered in an orbital plane and then off the orbital plane (inclination correction for GTO-GEO transfer or for certain planetary missions).

Figure 4:
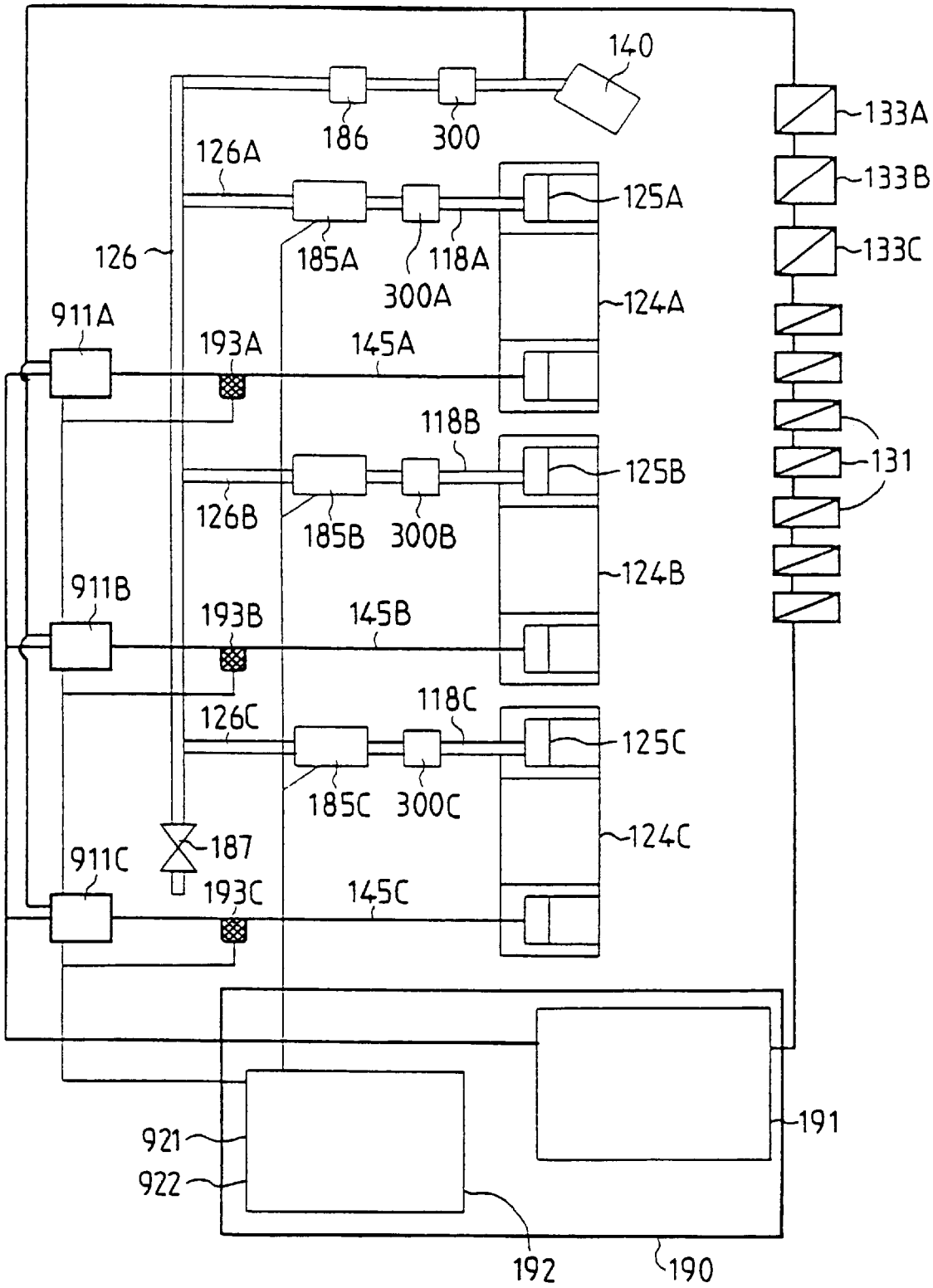
FIG. 4 is an electrical and fluid block diagram for a second embodiment of a plasma thruster of the invention, having three main annular channels.

In general, in accordance with the invention, the thrust vector is controlled by feeding thrust fluid separately to a plurality of main ionization and acceleration annular channels 124A to 124D included in a common magnetic circuit 134, and connected both to a single hollow cathode 140 and to a single feed block 190 (FIG. 4).

For a fixed radial magnetic field (as determined by the current carried by the common hollow cathode 140), there exists a certain mass flow rate margin, and thus a certain discharge current margin, for a closed electron drift motor operating in non-focused mode (also known as "spike mode"). Since thrust is substantially proportional to discharge current and to mass flow rate over a small range about the nominal operating point, it is easy to control the individual thrust of each channel 124A to 124D by modifying the mass flow rate. This is easily obtained by means of individual flow rate regulators 185A to 185D, e.g. comprising thermocapillary means controlled by a discharge current servo-control loop. It is also possible to use an electrically-controlled micro metering valve (having an actuator that is thermal, piezoelectric, or magnetostrictive).

In conventional stationary plasma thrusters, a current sensor is situated on the current return line (at a potential which is close to ground potential, since it is equal to the potential of the cathode minus the voltage drop in the coils).

In the present case, it is also necessary to measure the current of each anode. Since the anode potential is 300 V, it is preferable to perform this measurement by means of an electrically-isolated current pickup 193A to 193D. For example, it is possible to measure the current differential between two wires by placing a Hall effect sensor on the axis of two oppositely-wound solenoids, each solenoid carrying the current of one of the anodes.

FIG. 4 shows the electrical circuit of a thruster having three channels 124A to 124C (and thus having three anodes 125A to 125C). Each anode 125A to 125C is connected to the common feed via a filter constituted by an L-C circuit (911A to 911C). This serves to decouple the frequencies of oscillation between each of the channels, which frequencies can differ slightly because of the different mass flow rates.

Compared with a power supply block feeding a single thruster, the only additional complication consists in adding additional flow rate control regulators and isolated differential current pickups (92, 921, 922).

The circuit of FIG. 4 is naturally applicable to an embodiment having four channels 124A to 124D, such a the embodiment shown in FIGS. 9 and 10. Under such circumstances, all that is required is an additional branch whose elements are given the letter D.

In each branch corresponding to a channel 124A to 124D, a chamber comprises an anode 125A to 125D and a manifold 127A to 127D fed with ionizable gas by means of a hose 118A to 118D, an isolator (300A to 300D) and a flow rate regulator (185A to 185D), connected to a common feed hose segment 126 controlled by an electrically controlled valve 187. The common hose 126 also feeds the hollow cathode 140 by means of a head loss member 186 and an isolator 300. Discharge is established between the hollow cathode 140 and the anodes 125A to 125D by means of an electrical power supply circuit 191. The discharge oscillations in the various channels are decoupled by the filters 911A to 911D placed between the various anodes 125A to 125D and the cathode 140. The discharge current of each anode is controlled by a servo-control loop including a current pickup 193A to 193D, preferably an electrically-isolated pickup, a regulator 192 receiving a reference value 922 for thrust vector deflection for single axis control, or two reference values 922 for thrust vector deflection for two-axis control, and a reference value 921 for the total discharge current. The ion discharge and acceleration currents are controlled by the distribution of the magnetic field as determined by the external downstream polepiece 134 common to all of the channels, the external upstream polepiece 311 common to all of the channels, the external coils 131 mounted on the cores 137, and the internal polepieces 135A to 135D mounted on the cores 138A to 138D fitted with the coils 133A to 133D. The ends of all of the polepieces have profiles in the form of toruses coaxial about the axes 241A to 241D of the channels 124A to 124D. The internal coils 133A to 133D and the external coils 131 are connected in series between the cathode and the negative terminal of the electrical power supply circuit 191, while the various cores are connected upstream by means of the ferromagnetic bars 136. The regulator circuits make it possible to define in each channel 124A to 124D a flow rate range that extends typically from 50% to 120% of a nominal flow rate.

A variety of variant embodiments of the regulator circuits are possible.

Thus, in a particular variant, the number of external coils 131 is a multiple of the number of main annular channels 124A to 124D, with the coils of each subassembly of coils 131 allocated to each of the channels 124A to 124D being connected in series while the various subassemblies of coils 131 are connected in parallel, and the impedances of the coils connected in series are equal.

In another variant, the number of external coils 131 is a multiple of the number of annular channels 124A to 124D, and the coils in each of the subsets of coils 131 allocated to the various channels are powered by a current vernier.

In yet another variant, a digital loop is provided for servo-controlling the steering of the thrust vector, with the total thrust reference and the thrust vector deflection reference being given in digital form, and with the thrust vector deflection reference having priority over the total thrust reference in the event of the two references being incompatible.

It will be observed that the multiple channel thruster of the invention is capable of supplying the same capacity for controlling thrust as a single thruster mounted on a plate that allows it to swivel through 3°.

In the case of a single thruster applied, for example, to one of the satellites of a constellation, the distance between the thruster and the center of gravity of the satellite is about 1 meter (m). The torque induced by thrust F at a deflection angle of θ° is equal to C=F.sinθ, i.e. for θ=3°, C=0.0523 F.

With a thruster of the invention having two channels that are spaced apart by 140 mm, with each beam having a diameter of 100 mm, and with nominal unit thrust F1=F/2, if the axes of the individual channels diverge with a half-angle α of 10°, then the variation in torque that can be achieved by varying the individual thrust in each of the channels is:

$$C=(0.07+\sin 10°)\ (\Delta F_{1-\Delta F2})$$

$$C=0.21136\ (\Delta F_1-\Delta F_2)$$

For equal absolute values in the variations, implementing a controlled relationship gives:

$$\Delta F_1=0.215F_1.$$

The variation in thrust is thus about 20% and it is easy to control.

In terms of additional mass of ionizable gas on board a satellite, such as a telecommunications satellite weighing 150 kg, it can be observed that prior art embodiments have two steering plates so the additional on-board mass is greater than 12 kg. With a thruster of the invention having a single steering plate and multiple channels, it is necessary for the additional mass of ionizable gas such as xenon to be about 2 kg which is much less than the additional mass required by prior art devices having two steering plates.

What is claimed is:

1. A closed electron drift plasma thruster having a steerable thrust vector, the thruster comprising at least one main annular ionization and acceleration channel fitted with an anode and ionizable gas feed means, a magnetic circuit for creating a magnetic field in said main annular channel, and a hollow cathode associated with the ionizable gas feed means, wherein the thruster comprises a plurality of main annular ionization and acceleration channels having axes that are not parallel and that converge downstream from the outlets of said main annular channels, wherein the magnetic circuit for creating a magnetic field comprises a first external polepiece that is downstream and common to all of the annular channels, a second external polepiece common to all of annular channels and that is disposed upstream from the downstream first external polepiece, a plurality of internal polepieces in number equal to the number of main annular channels and mounted on first cores disposed about the axes of the main annular channels, a plurality of first coils disposed respectively around the plurality of first cores, and a plurality of second coils mounted on second cores disposed in empty spaces left between the main annular channels, said second cores of the second coils being interconnected via their upstream portions by ferromagnetic bars and being connected via their downstream portions to said downstream first external polepiece, and wherein the thruster comprises means for regulating the ionizable gas feed flow rate to each of the main annular channels and means for controlling the ion discharge and acceleration current in the main annular channels.

2. A plasma thruster according to claim 1, wherein the axes of the main annular ionization and acceleration channels converge on the geometrical axis of the thruster.

3. A plasma thruster according to claim 1, wherein the axes of the main annular ionization and acceleration channels form angles lying in the range 5° to 20° with the geometrical axis of the thruster.

4. A plasma thruster according to claim 1, wherein each main annular ionization and acceleration channel comprises an anode associated with a manifold fed with ionizable gas by means of a pipe connected via an isolator to a flow rate regulator.

5. A plasma thruster according to claim 1, wherein the hollow cathode is fed by a pipe connected via an isolator to a head loss member.

6. A plasma thruster according to claim 4, wherein the hollow cathode is fed by a pipe connected via an isolator to a head loss member, and wherein the flow rate regulators and the head loss member are fed from a common pipe controlled by an electrically controlled valve.

7. A plasma thruster according to claim 4, wherein the hollow cathode is fed by a pipe connected via an isolator to a head loss member, wherein the thruster comprises an electrical power supply circuit for setting up discharge between the hollow cathode and the anodes, and wherein the discharge oscillations of the main annular channels are decoupled by filters placed between the cathode and the anodes.

8. A plasma thruster according to claim 7, wherein, in order to control the discharge currents of the anodes, the thruster comprises servo-control loops comprising current pickups and a current regulator acting on the flow rate regulators and receiving a total current discharge reference value and at least one thrust vector deflection reference value for steering about at least one axis, the ion discharge and acceleration current being controlled by a magnetic field distribution determined by said magnetic circuit in which the plurality of first coils and the plurality of second coils are connected in series between the cathode and the negative terminal of the electricity power supply circuit.

9. A plasma thruster according to claim 8, wherein the flow rate regulators are constituted by thermocapillary means controlled by discharge current servo-control loops.

10. A plasma thruster according to claim 8, wherein the flow rate regulators are constituted by electrically controlled micromeasuring valves that are actuated thermally, piezoelectrically, or magnetostrictively.

11. A plasma thruster according to claim 8, wherein the current pickups are electrically-isolated in order to measure the current in each of the anodes at a potential of several hundred volts.

12. A plasma thruster according to claim 1, wherein the range of flow rates in each main annular channel extends from 50% to 120% of the nominal flow rate.

13. A plasma thruster according to claim 1, wherein the number of second coils lies in the range 4 to 10.

14. A plasma thruster according to claim 1, comprising a common baseplate acting as a radiator and as a housing for the electrical and fluid connections.

15. A plasma thruster according to claim 1, comprising two main annular ionization and acceleration channels.

16. A plasma thruster according to claim 14, comprising two main annular ionization and acceleration channels making it possible to provide control about a first axis using means for adjusting the ionizable gas feed rate, and wherein the thruster further comprises mechanical hinge means to the baseplate of the thruster about a different axis.

17. A plasma thruster according to claim 16, wherein the baseplate of the thruster is hinged about said second axis with a maximum angle of 50°.

18. A plasma thruster according to claim 16, wherein the baseplate of the thruster is hinged about said second axis on two ball bearings which are prestressed by at least one flexible membrane mounted on a fixed platform and which are fixed directly to the baseplate, the center of gravity of the moving assembly being situated close to the vicinity of the axis of rotation and the angle of rotation being controlled by an electronic motor and a stepdown gear that provide angular locking.

19. A plasma thruster according to claim 1, comprising three main annular ionization and acceleration channels distributed in a triangle about the axis of the thruster.

20. A plasma thruster according to claim 1, comprising four main annular ionization and acceleration channels disposed in a square about the axis of the thruster.

21. A plasma thruster according to claim 1, wherein the number of second coils is a multiple of the number of main annular ionization and acceleration channels, wherein the coils of each subset of second coils allocated to each channel are connected in series, and wherein the various subsets of second coils are connected in parallel, with the impedances of the coils connected in series being equal.

22. A plasma thruster according to claim 1, wherein the number of second coils is a multiple of the number of main annular ionization and acceleration channels, and wherein the coils of each of the subsets of second coils allocated to the various channels are powered via a current vernier.

23. A plasma thruster according to claim 1, comprising a digital servo-control loop for steering the thrust vector, the total thrust reference value and the thrust vector deflection value being given in digital form, and the thrust vector deflection reference value having priority over the total thrust reference value in the event of the two reference values being incompatible.

24. A plasma thruster according to claim 1, wherein the means for regulating the ionizable gas feed rate receive two reference values for thrust vector deflection to provide control about two axes.

* * * * *

UNITED STATES PATENT AND TRADEMARK OFFICE

CERTIFICATE OF CORRECTION

PATENT NO. : 6,279,314 B1 
DATED : August 28, 2001
INVENTOR(S) : Dominique Valentian et al.

It is certified that error appears in the above-identified patent and that said Letters Patent is hereby corrected as shown below:

Drawings,
Please replace FIG. 16 to read as follows:

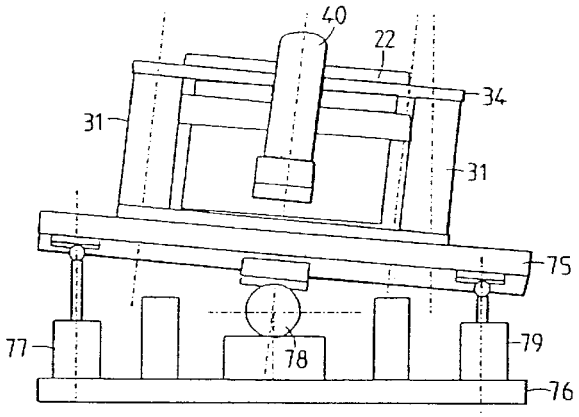

FIG.16
PRIOR ART

Column 1,
Line 65, "30," should read -- 3º --; and

Column 10,
Line 23, "($\Delta_{F1-\Delta F2}$)" should read -- ($\Delta F_1$-$\Delta F_2$) --.

Signed and Sealed this

Tenth Day of September, 2002

*Attest:*

*Attesting Officer*

JAMES E. ROGAN
*Director of the United States Patent and Trademark Office*